US008424749B2

(12) United States Patent
Costanzo, Jr.

(10) Patent No.: US 8,424,749 B2
(45) Date of Patent: Apr. 23, 2013

(54) ONE-PIECE BOX WITH INTEGRALLY CONNECTED LID

(75) Inventor: Donn J. Costanzo, Jr., Fort Mill, SC (US)

(73) Assignee: Thatbox Design, LLC, Fort Mill, SC (US)

( * ) Notice: Subject to any disclaimer, the term of this patent is extended or adjusted under 35 U.S.C. 154(b) by 0 days.

(21) Appl. No.: 13/462,799

(22) Filed: May 2, 2012

(65) Prior Publication Data

US 2012/0234904 A1 Sep. 20, 2012

Related U.S. Application Data

(63) Continuation of application No. 13/420,411, filed on Mar. 14, 2012.

(60) Provisional application No. 61/452,640, filed on Mar. 14, 2011.

(51) Int. Cl.
*B65D 5/68* (2006.01)
*B65D 43/16* (2006.01)

(52) U.S. Cl.
USPC ..... 229/144; 206/45.29; 229/125; 229/145

(58) Field of Classification Search ..... 229/125, 229/138, 140, 144, 145, 188; 206/736, 45.21, 206/45.23, 45.29; 40/313
See application file for complete search history.

(56) References Cited

U.S. PATENT DOCUMENTS 662,619 A * 11/1900 Foltz ..... 229/143
1,075,844 A * 10/1913 Miller ..... 40/313
1,190,797 A * 7/1916 Powell ..... 229/188
2,017,129 A * 10/1935 Osterberg ..... 229/145
2,019,995 A * 11/1935 Rippen ..... 229/125
2,512,382 A 6/1950 Ringler
2,532,479 A 12/1950 Burgess (Continued)

FOREIGN PATENT DOCUMENTS

EP 337280 A1 * 10/1989 ..... 229/188
WO 9611848 A1 4/1996

OTHER PUBLICATIONS

Information Disclosure Statement (IDS) Letter Regarding Common Patent Application(s), dated Oct. 2, 2012.
Canadian Application No. 2,201,965—Apr. 25, 1995—Dalvey.

*Primary Examiner* — Gary Elkins
(74) *Attorney, Agent, or Firm* — Tillman Wright, PLLC; Chad D. Tillman; Jeremy C. Doerre

(57) ABSTRACT

A one-piece container includes a single sheet of corrugated material, including: four walls, a bottom, and a lid, the lid being hingedly and integrally connected to one of the four walls. The bottom and the four walls define a storage area for housing articles therein. The lid is configured to transition between an open position, an intermediate position, and a closed position. The one-piece container includes a mechanism for maintaining the lid in a closed position. In some embodiments, the mechanism biases the lid toward a closed position when in the closed position, an open position when in the open position, and an intermediate position when in the intermediate position. In other embodiments, the mechanism includes tabs and slots for retaining the lid in the closed position. Other embodiments include a combination of these features. The container may be a cardboard box.

19 Claims, 9 Drawing Sheets

U.S. PATENT DOCUMENTS

| | | | | | |
|---|---|---|---|---|---|
| 3,119,547 | A | | 1/1964 | Nute | |
| 3,154,052 | A | * | 10/1964 | Sweeney | 229/144 |
| 3,199,762 | A | | 8/1965 | Coons | |
| 3,309,970 | A | | 3/1967 | Pierce | |
| 4,006,670 | A | | 2/1977 | Royal | |
| 4,068,795 | A | * | 1/1978 | Forster | 229/144 |
| 4,119,265 | A | | 10/1978 | Dlugopolski | |
| 4,341,341 | A | * | 7/1982 | Roccaforte | 229/138 |
| 4,890,576 | A | * | 1/1990 | James | 119/168 |
| 4,979,669 | A | * | 12/1990 | Kerton | 229/144 |
| 5,020,337 | A | | 6/1991 | Krieg | |
| 5,062,527 | A | | 11/1991 | Westerman | |
| 5,094,359 | A | | 3/1992 | DeMars et al. | |
| 5,284,294 | A | | 2/1994 | Floyd | |
| 5,303,863 | A | | 4/1994 | Arasim | |
| 5,307,986 | A | | 5/1994 | Schuster | |
| 5,562,228 | A | | 10/1996 | Ericson | |
| 6,164,526 | A | | 12/2000 | Dalvey | |
| 6,736,309 | B1 | | 5/2004 | Westerman et al. | |
| 6,837,420 | B2 | | 1/2005 | Westerman et al. | |
| 7,841,512 | B2 | | 11/2010 | Westerman et al. | |
| 7,870,995 | B1 | * | 1/2011 | Kaltman et al. | 229/175 |
| 2008/0290149 | A1 | * | 11/2008 | Sweet | 229/140 |
| 2012/0234903 | A1 | | 9/2012 | Costanzo, Jr. | |

* cited by examiner

10

10

10

10

ONE-PIECE BOX WITH INTEGRALLY CONNECTED LID

CROSS-REFERENCE TO RELATED APPLICATION

The present application is a U.S. continuation patent application of, and claims priority under 35 U.S.C. §120 to, U.S. patent application Ser. No. 13/420,411, filed Mar. 14, 2012, pending, which '411 application and any publication thereof or patent issuing therefrom is incorporated herein by reference, and which '411 application is a U.S. nonprovisional patent application of, and claims priority under 35 U.S.C. §119(e) to, U.S. provisional patent application Ser. No. 61/452,640, filed Mar. 14, 2011, which '640 application is incorporated herein by reference. Furthermore, the appendix hereto includes the disclosure of the '640 application relevant to the present application, which disclosure of the appendix is incorporated by reference herein. The present application hereby incorporates herein by reference U.S. Patent Application Publication No. 2010/0234904, which will sometimes hereinafter be referred to as "the '904 publication".

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to a one piece box with an integrally connected lid. One-piece boxes with integrally connected lids are generally well-known. However, it is thought that these containers generally do not remain closed without a separate mechanism for retaining the lids in a closed position. Accordingly, it is believed that a need exists for improvement in one-piece boxes with integrally connected lids. This, and other needs, are addressed by one or more aspects of the present invention.

SUMMARY OF THE INVENTION

The present invention includes many aspects and features. Moreover, while many aspects and features relate to, and are described in, the context of a once-piece box with an integrally connected lid, the present invention is not limited to use only in such one-piece boxes, as will become apparent from the following summaries and detailed descriptions of aspects, features, and one or more embodiments of the present invention.

Accordingly, one aspect of the present invention relates to a one-piece container with a hingedly connected lid as substantially shown and described.

In an aspect of the invention, a blank for forming a container by folding comprises a single sheet of material. The single sheet of material comprises a bottom section; four side wall sections; four side wall attachment portions; and a lid section. Fold lines in the sheet of material preferably define these elements therebetween. Additionally, the lid section comprises a top portion, a left side portion having a plurality of lid fold lines (preferably three lid fold lines), a right side portion having a plurality of lid fold lines (preferably three lid fold lines), a front portion having a two slots, a left side tab portion, and a right side tab portion. The lid fold lines of the left side portion of the lid and the lid fold lines of the right side portion of the lid are located such that, when the blank is folded and glued to form the container, the fold lines collectively bias the lid to maintain a stable open position of the container when in such open position; a stable intermediate position when in such intermediate position, and a stable closed position when in such closed position.

In a feature, the single sheet of material comprises a generally planar sheet of corrugated material.

In a feature, the single sheet of material comprises cardboard.

In another feature, the blank further comprise a decorative element applied to an exterior surface of the single sheet of material. The decorative element may be adhered to a surface of the single sheet of material using adhesives, or the decorative element may be printed directly on a surface of the single sheet of material.

In another aspect of the invention, a method of forming a container by folding a blank comprising a single sheet of material includes the step of providing a single sheet of material. The sheet of material that is provided comprises a bottom section; four side wall sections; four side wall attachment portions; and a lid section. The lid section comprises a top portion; a left side portion having three lid fold lines; a right side portion having three lid fold lines; a front portion having a two slots; a left side tab portion; and a right side tab portion. The method further includes the steps of folding each of the side wall sections perpendicular to the bottom section; attaching the outer surfaces of the four side wall attachment portions to the inner surfaces of the side wall sections; folding the lid section such that the left side portion, the right side portion, and the front portion are folded downward and perpendicular to the top portion; folding the left side tab portion and the right side tab portion perpendicular to the left side portion and right side portion, respectively; and inserting the left side tab portion and the right side tab portion into respective slots of the front portion. The steps are performed such that the three lid fold lines of the left side portion of the lid and the three lid fold lines of the right side portion of the lid collectively bias the lid to maintain a stable open position of the container when in such open position; a stable intermediate position when in such intermediate position; and a stable closed position when in such closed position.

In a feature, the step of attaching the outer surfaces of the four side wall attachment portions to the inner surfaces of the side wall sections is performed using an adhesive.

In another aspect, a container comprising a single sheet of material, the single sheet of material comprising a bottom section; four side wall sections; four side wall attachment portions; and a lid section. The lid section in turn comprises atop portion; a left side portion having three lid fold lines; a right side portion having three lid fold lines; a front portion having a two slots; a left side tab portion; and a right side tab portion. The three lid fold lines of the left side portion of the lid and the three lid fold lines of the right side portion of the lid are located such that the fold lines collectively bias or urge the lid to maintain a stable open position of the container when in such open position; a stable intermediate position when in such intermediate position, and a stable closed position when in such closed position.

In a feature, the single sheet of material comprises a generally planar sheet of corrugated material that is folded.

In a feature, the single sheet of material comprises cardboard.

In a feature, the container further comprises a decorative element applied to an exterior surface of the single sheet of material. The decorative element may be adhered to a surface of the single sheet of material using adhesives, or the decorative element may be printed directly on a surface of the single sheet of material.

In additional features, each of the side wall sections extend generally perpendicular to the bottom section; the outer surfaces of the four side wall attachment portions are attached to the inner surfaces of the side wall sections; the left side portion, the right side portion, and the front portion extend generally perpendicular to the top portion; the left side tab portion and the right side tab portion extend generally perpendicular to the left side portion and right side portion, respectively; and the left side tab portion and the right side tab portion extend into respective slots of the front portion. Furthermore, the outer surfaces of the four side wall attachment portions preferably are attached to the inner surfaces of the side wall sections with an adhesive such as glue.

In another aspect, a one-piece container comprises a single, folded sheet of material. The single, folded sheet of material comprises a bottom section; four wall sections, including a first wall section having a first slotted opening, and a second wall section, opposite to the first wall section, having a second slotted opening; a first flap section, integrally and hingedly attached to a third wall section; and a second flap section, integrally and hingedly attached to a fourth wall section, opposite to the third wall section, the second cover portion having a first side with a first tab and a second side, opposite to the first side, with a second tab. The bottom section and the four wall sections define a storage area adapted to house articles therein; the first flap section and second flap section together define a cover for the storage area; and the second flap section is secured in a covering orientation by inserting the first tab into the first slotted opening and the second tab into the second slotted opening, and the first flap section is secured in a covering orientation by the second flap section.

In a feature, the first flap section is secured in a covering orientation by the second flap section by a portion of the second flap section extending over and abutting the first flap section.

In a feature, the single sheet of material comprises a generally planar sheet of corrugated material that is folded.

In another aspect, a blank for forming a one-piece container when folded comprise a single sheet of material, which in turn, comprises: a bottom section; four wall sections, including a first wall section having a first slotted opening, and a second wall section, opposite to the first wall section, having a second slotted opening; a first flap section, integrally and hingedly attached to a third wall section; and a second flap section, integrally and hingedly attached to a fourth wall section, opposite to the third wall section, the second cover portion having a first side with a first tab and a second side, opposite to the first side, with a second tab. The bottom section and the four wall sections define a storage area adapted to house articles therein when the blank is folded. Furthermore, the first flap section and second flap section together define a cover for the storage area when the blank is folded; and the second flap section is secured in a covering orientation by inserting the first tab into the first slotted opening and the second tab into the second slotted opening, and the first flap section is secured in a covering orientation by the second flap section when the blank is folded.

In yet another aspect, a one-piece container includes a single sheet of corrugated material, including four walls, a bottom, and a lid, the lid being hingedly and integrally connected to one of the four walls. Furthermore, the bottom and the four walls define a storage cavity or storage area for housing articles therein, and the lid is configured to transition between an open position, an intermediate position, and a closed position.

In a feature of this aspect, the lid comprises a plurality of fold lines adapted to cause the lid to maintain either the open position, the intermediate position, or the closed position.

In a variation of this feature, the plurality of fold lines includes three fold lines on a left side of the lid and three fold lines on a right side of the lid.

Another aspect of the present invention relates to a one-piece container comprising a single sheet of corrugated material, including a bottom, four walls, including a first wall having a first slotted opening, and a second wall, opposite the first wall, having a second slotted opening, a first flap, integrally and hingedly attached to a third wall, and a second flap, integrally and hingedly attached to a fourth wall, opposite the third wall, the second cover portion having a first side with a first tab and a second side, opposite the first side, with a second tab. Furthermore, the bottom and the four walls define a storage area adapted to house articles therein, the first flap and second flap together define a cover for the storage area, and the second flap is secured in a covering orientation by inserting the first tab into the first slotted opening and the second tab into the second slotted opening, and the first flap is secured in a covering orientation by the second flap.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

DETAILED DESCRIPTION

Figure 1:
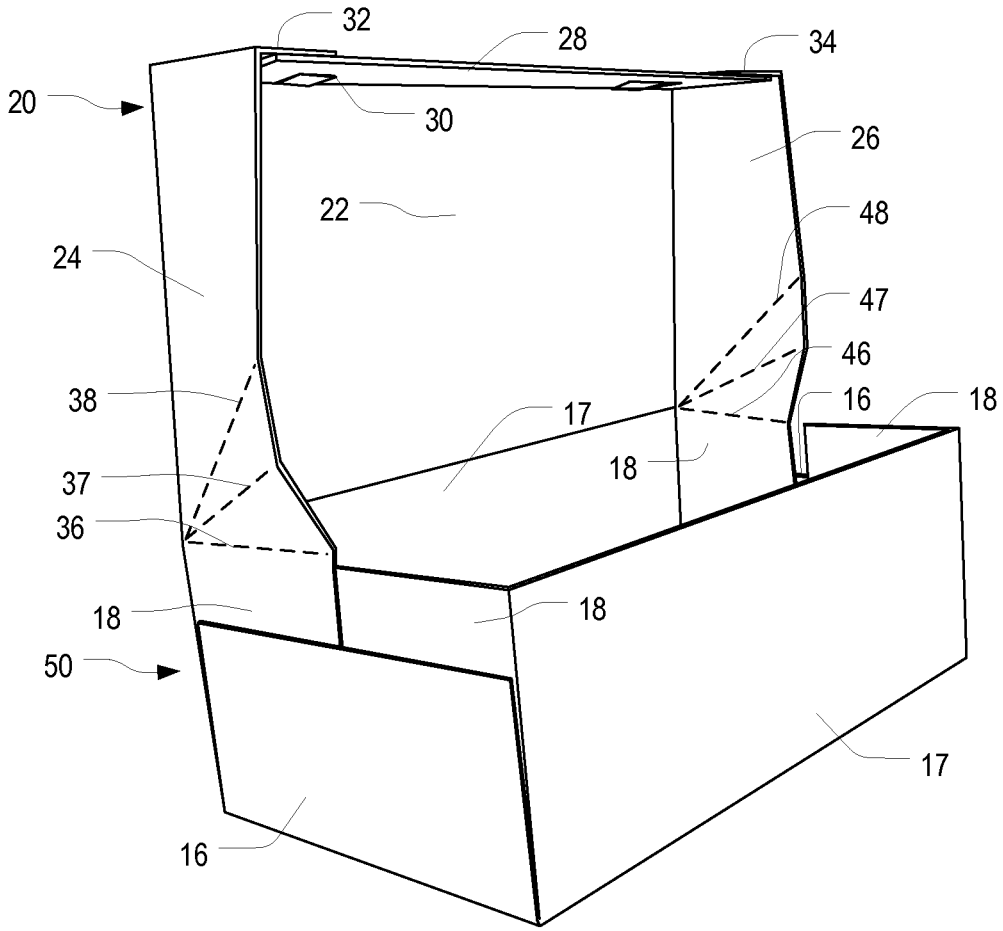
FIG. 1 is a perspective view of a preferred embodiment of a one-piece box in accordance with one or more aspects of the present invention, showing the lid being maintained in a stable, open position.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 2:
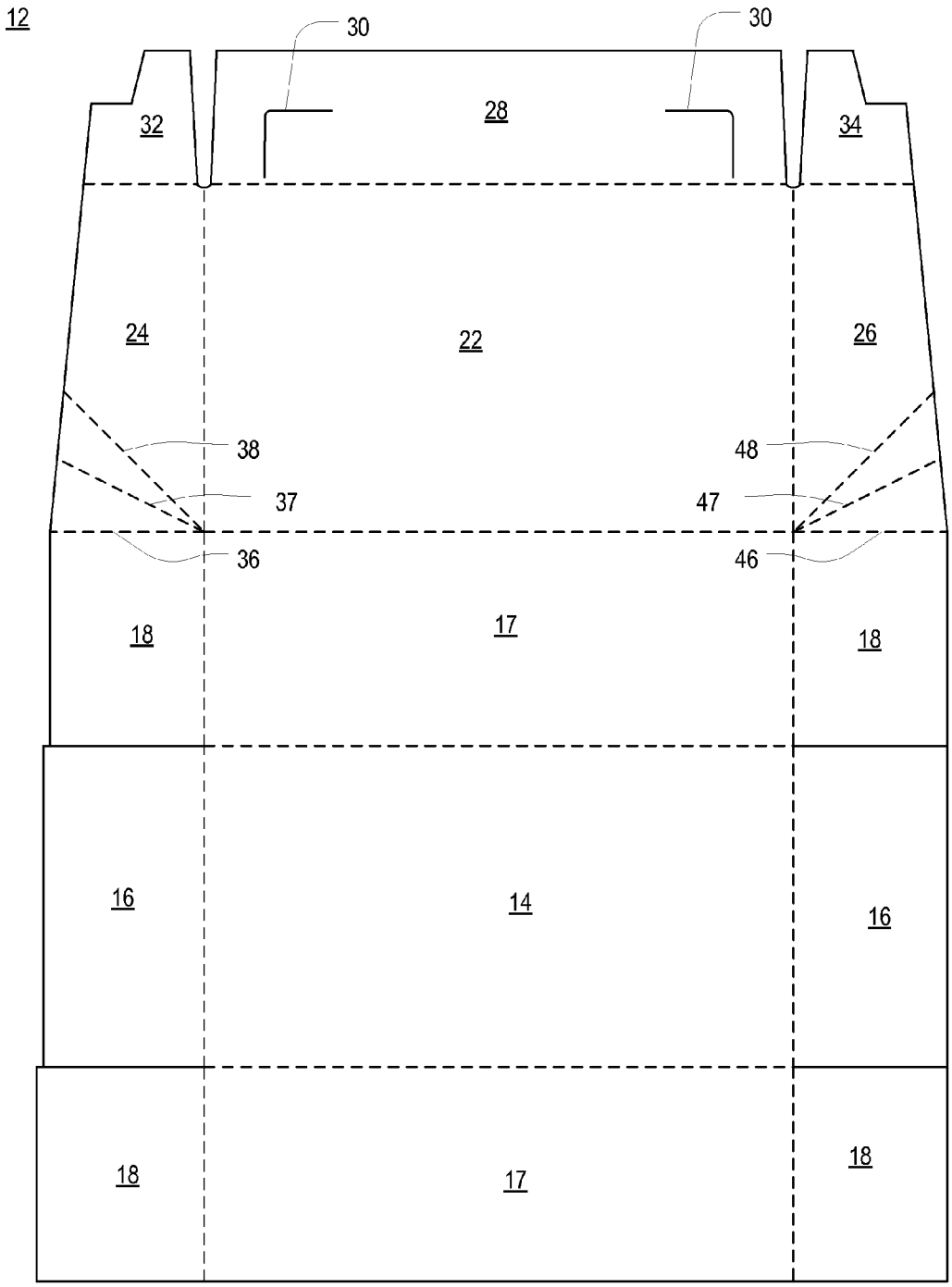
FIG. 2 is a top view of a single sheet of corrugated material, or blank, that is used to make the box of FIG. 1 by folding along the fold lines.

FIG. 1 is a perspective view of a foldable box 10 in accordance with one or more preferred embodiments of the present invention. An exemplary such box 10 comprises a single sheet 12 of material or blank, as shown in FIG. 2, and preferably, comprises a corrugated material or cardboard and may be single-ply or multiply in thickness. FIG. 2 is a top view of the inner surface of the single sheet 12 of corrugated material. To form a box 10 from the single sheet 12 of corrugated material, the single sheet 12 of corrugated material is folded along various fold lines and glued. As an alternative, or in addition to, gluing, portions of the single sheet 12 of corrugated material may be formed into tabs and slots, the tabs adapted to be inserted in to the slots to form the box 10.

As shown in FIGS. 1 and 2, the single sheet 12 of corrugated material includes a bottom 14, four side walls 16,17, four side wall attachment portions 18, and a lid 20. The lid includes a top 22, a left side 24 having three lid fold lines 36,37,38, a right side 26 having three lid fold lines 46,47,48, a front 28 having a two slots 30, a left side tab 32, and a right side tab 34.

In at least one preferred embodiment, the single sheet 12 of corrugated material is shipped as blank in order to save space. Furthermore, multiple blanks can be packaged and shipped together. These blanks then may be assembled into boxes upon receipt, after shipping, when needed.

To form the box 10 from the single corrugated sheet 12, each of the side walls 16,17 is folded perpendicular to the base 14, and the outer surfaces of the four side wall attachment portions 18 are attached to the inner surfaces of the side walls 16 using an adhesive or other suitable attachment method. Next, the lid 20 is formed such that the left side 24, the right side 26, and the front 28 are folded downward and perpendicular to the top 22. The left side tab 32 and right side tab 34 are folded perpendicular to the left side 24 and right side 26, respectively, and are each inserted into their respective slots 30. The box 10 shown in FIG. 1 is thus assembled from the blank of FIG. 2.

Once formed, the box 10 includes a storage portion 50, defining an opening, and adapted to house objects therein, and a lid 20 hingedly connected and integral with the storage portion 50. In at least one preferred embodiment, the lid 20 is adapted to transition between an open position, an intermediate position, and a closed position. The open, intermediate, and closed positions are distinct and discrete from each other. The lid 20 includes a biasing mechanism that that encourages the lid 20 to remain in either the open, intermediate or closed position until acted upon by a force large enough to overcome the force exerted by the biasing mechanism. In at least one preferred embodiment, the biasing mechanism comprises a plurality of fold lines 36,37,38,46,47,48 on left and right sides of the lid 20.

FIG. 1 illustrates the box 10 in the open position. In the open position, the top of the lid 20 is perpendicular to the base 14 and the contents of the box 10 are exposed. Furthermore, it is noted that the left side 24 and right side 26 are not folded along any of the fold lines 36,37,38,46,47,48.

Figure 3A:
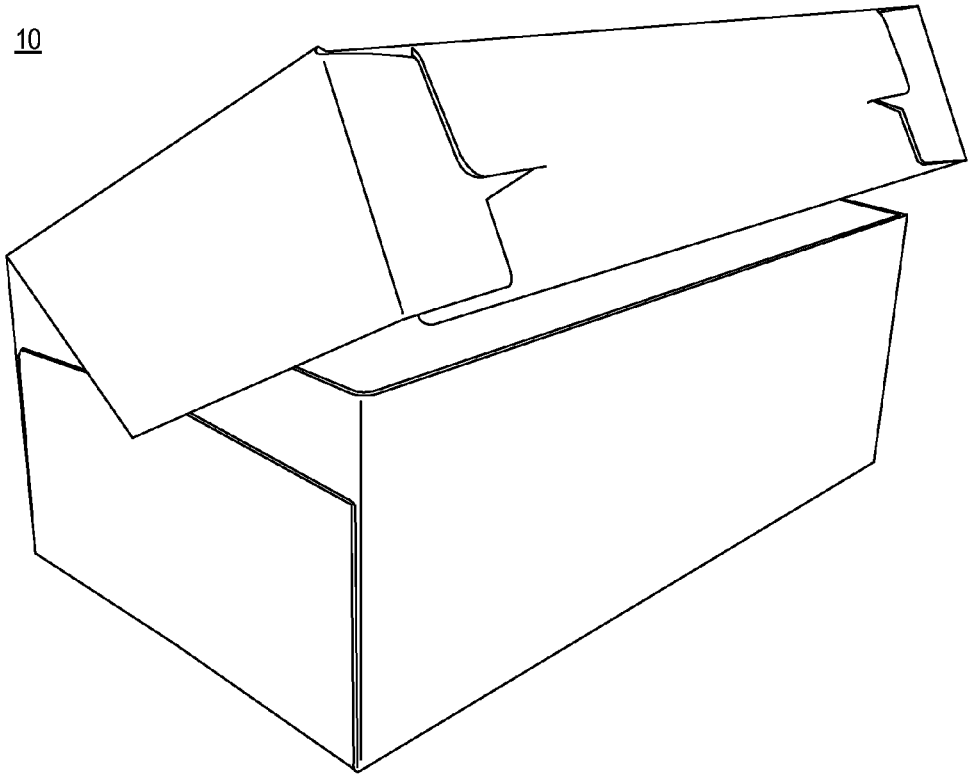
FIGS. 3A and 3B are perspective and side views of the box of FIG. 1 showing the lid being maintained in a stable, intermediate position.
Figure 3B:
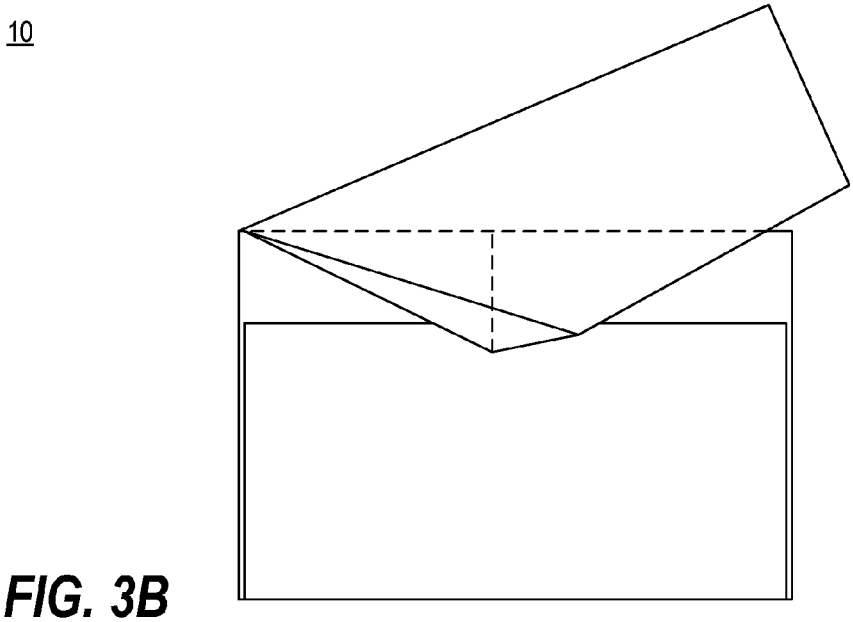

FIGS. 3A and 3B illustrate the box 10 of FIG. 1 in the intermediate position. In the intermediate position, the top 22 of the lid 20 is at an angle between zero and ninety degrees relative to the base 14. In the intermediate position, the left side 24 is folded 180 degrees along fold 36 and the right side 26 is folded 180 degrees along fold 46. Furthermore, the left and right sides 24,26 are folded substantially less than 180 degrees along fold lines 37,38,47,48. This is perhaps best illustrated in FIG. 3B, showing the hidden fold line 36 in dashed lines.

Figure 4A:
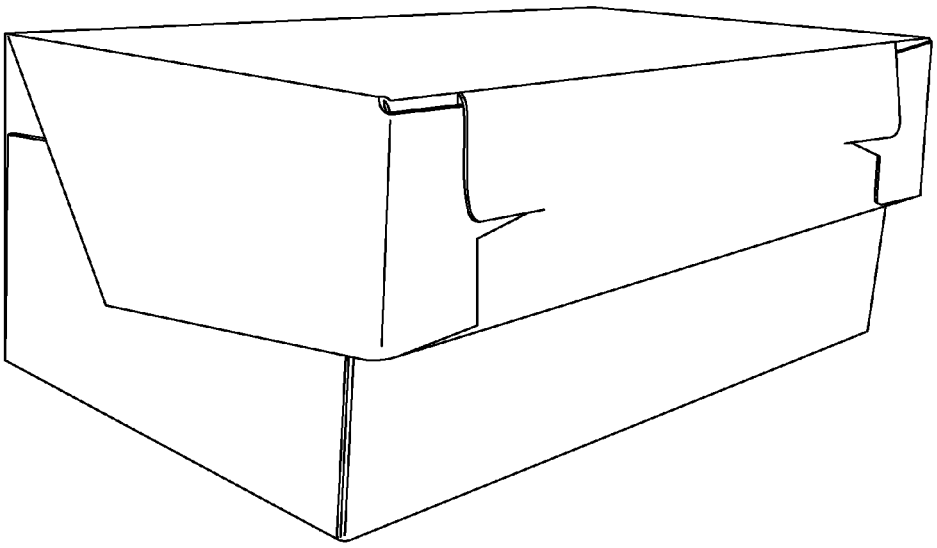
FIGS. 4A and 4B are perspective and side views of the box of FIG. 1 showing the lid being maintained in a stable, closed position.
Figure 4B:
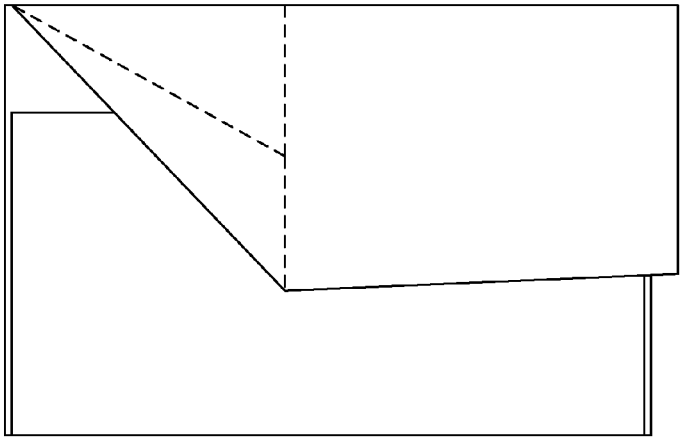

FIGS. 4A and 4B illustrate the box 10 of FIG. 1 in the closed position. In the closed position, the top 22 of the lid 20 is parallel to the base 14, and lid 20 completely covers the opening of the storage portion 50. In the closed position, the left side 24 is folded 180 degrees along both fold line 36 and fold line 38, and the right side 26 is folded 180 degrees along both fold line 46 and fold line 48. This is perhaps best illustrated in FIG. 4B, showing the hidden fold line 37 in dashed lines.

Figure 5:
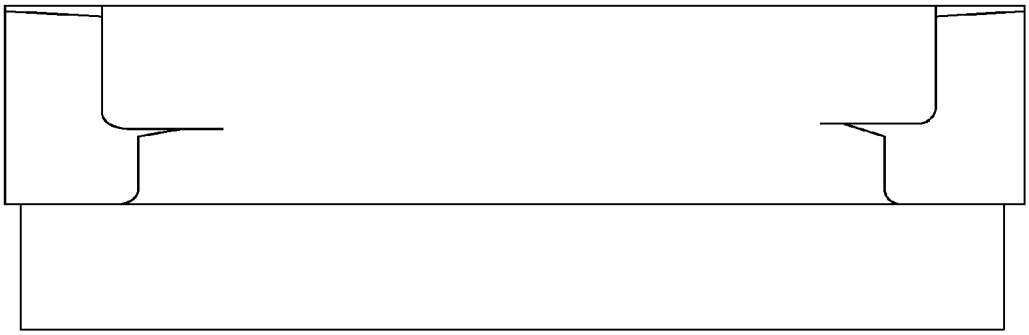
FIG. 5 is a front view of the box of FIG. 1.
Figure 6:
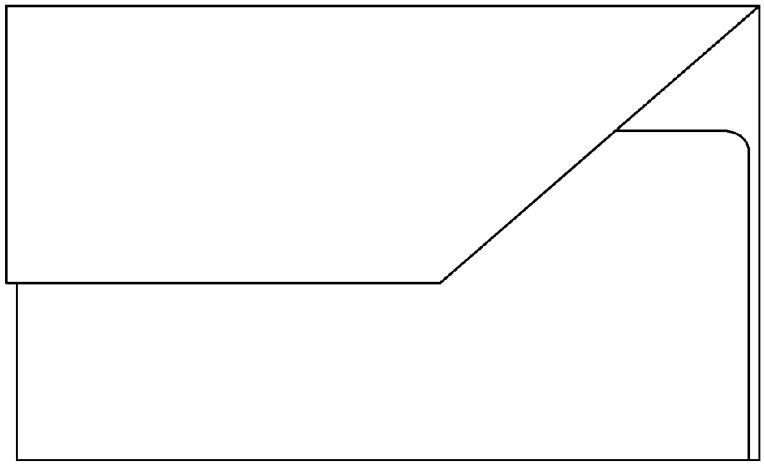
FIG. 6 is a right side view of the box of FIG. 1.
Figure 7:
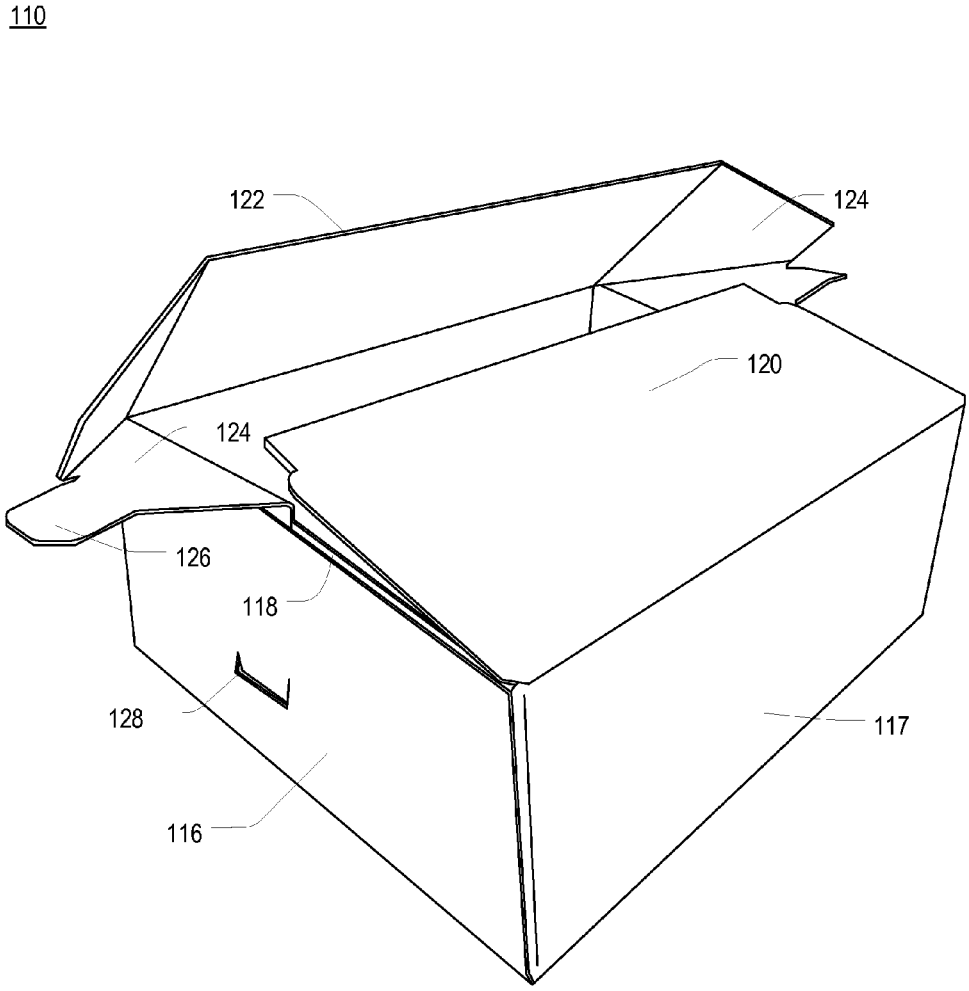
FIG. 7 is a perspective view of another preferred embodiment of a one-piece box in accordance with one or more aspects of the present invention.
Figure 8:
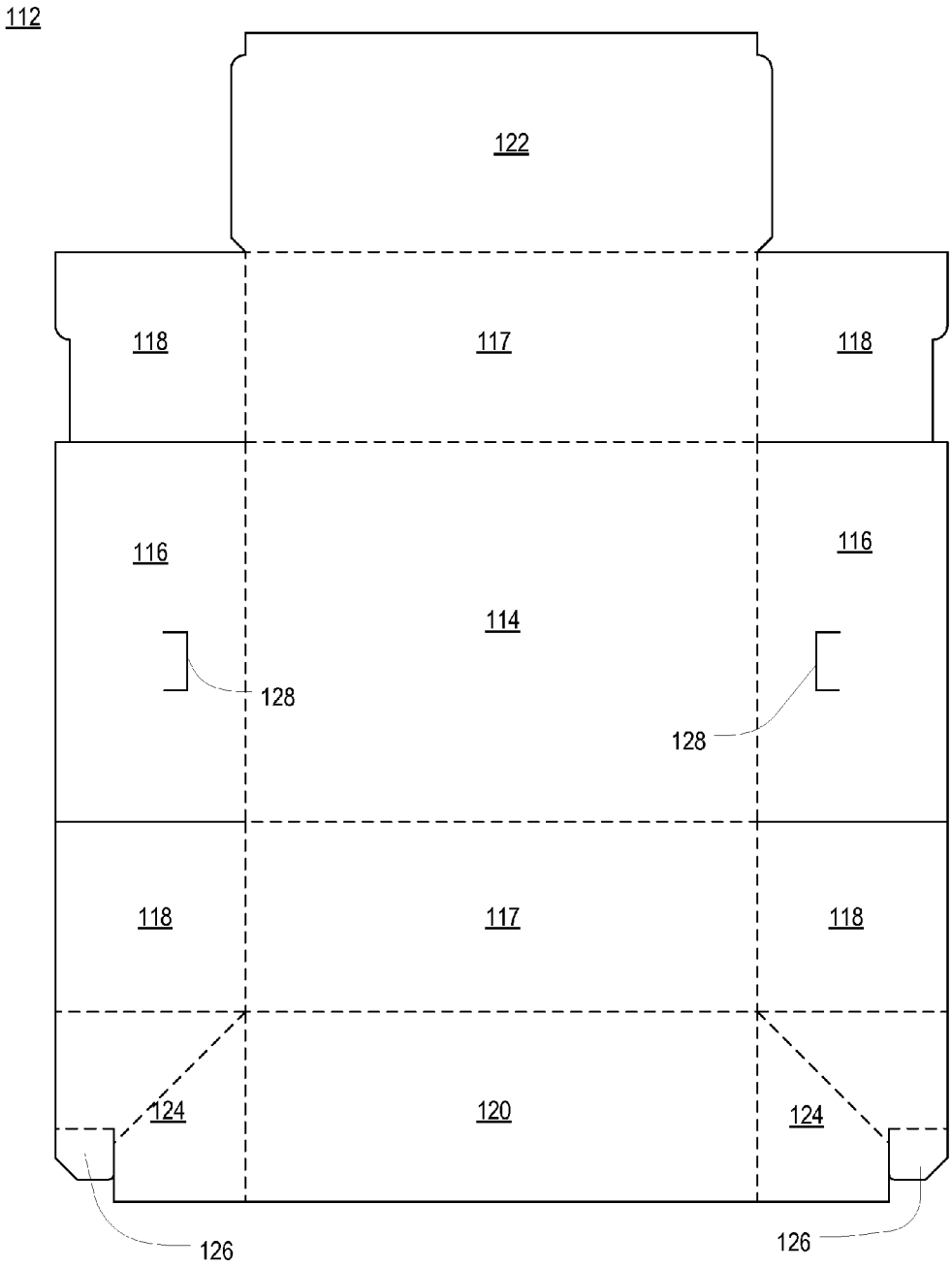
FIG. 8 is a top view of a single sheet of corrugated material, or blank, that is used to make the box of FIG. 7 by folding along the fold lines.
Figure 9:
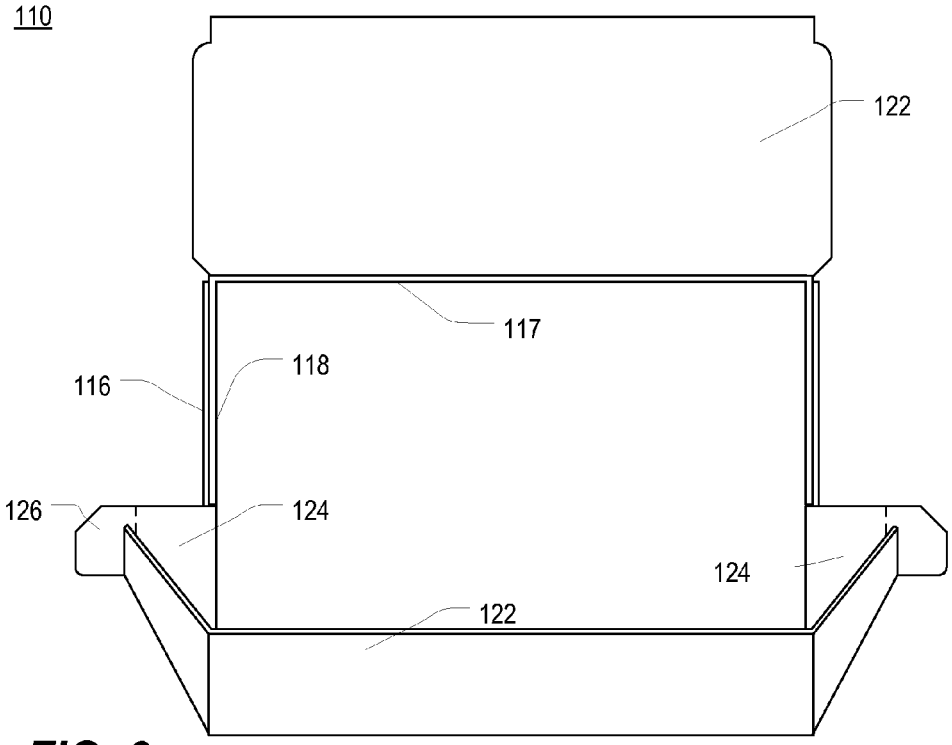
FIG. 9 is a top view of the box of FIG. 7 with the first and second lid portions open.
Figure 10:
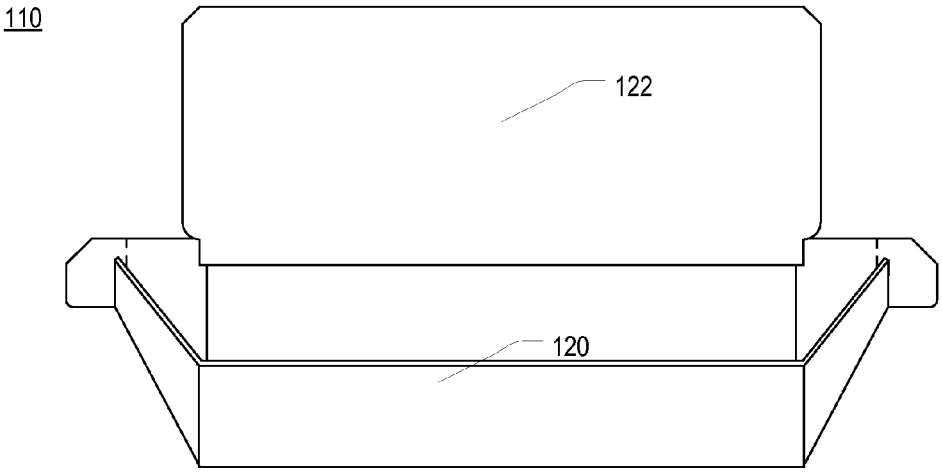
FIG. 10 is a top view of the box of FIG. 7 with the first lid portion open and the second lid portion closed.
Figure 11:
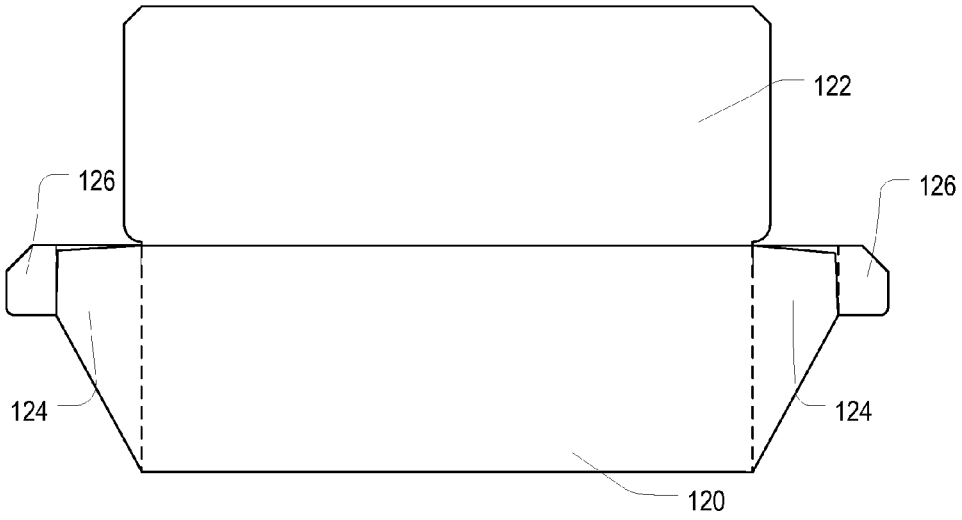
FIG. 11 is a top view of the box of FIG. 7 with the first and second lid portions closed.
Figure 12:
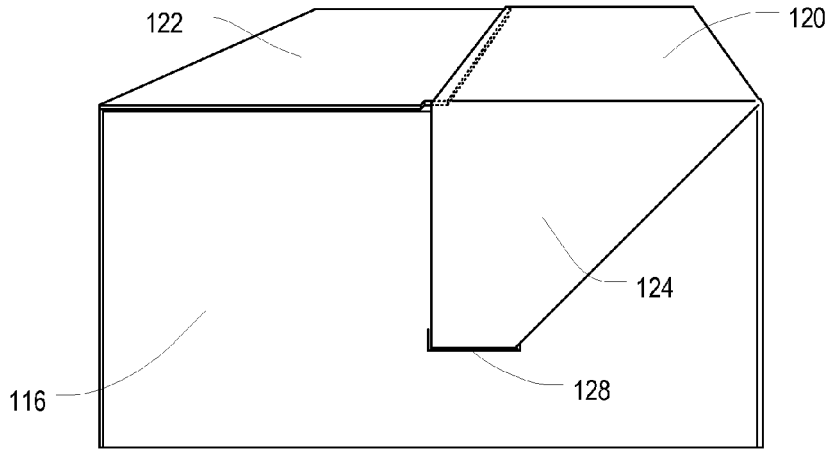
FIG. 12 is a side perspective view of the box of FIG. 7.

FIGS. 5 and 6 are front and right side views, respectively, of the box 10 in the closed position.

An exemplary embodiment of the box 10 is shown in drawings 7-12 of the '904 publication. In particular, drawing 7 of the '904 publication is a photograph of a front view of a box in accordance with one or more embodiments of the present invention; drawing 8 of the '904 publication is a photograph of a right side view of the box drawing of 7 of the '904 publication; drawing 9 of the '904 publication is a photograph of a bottom view of the box of drawing 7 of the '904 publication; 10 of the '904 publication is a photograph of the box of drawing 7 of the '904 publication with the lid in the intermediate position; drawing 11 of the '904 publication is a photograph of the box of drawing 7 of the '904 publication with the lid in the open position; and drawing 12 of the '904 publication is a photograph of the box of drawing 7 of the '904 publication, showing the left and right side tabs removed from the slots in the front of the lid.

FIG. 13 is a perspective view of a box 110 in accordance with a preferred embodiment of another aspect of the present invention. The box 110 comprises a single sheet 112 of corrugated material and, preferably, corrugated material or cardboard and may be single-ply or multiply in thickness To assemble the box 110 from the single sheet 112 of corrugated material, the single sheet 112 of corrugated material is folded along various fold lines and attached at various places using an adhesive or other appropriate attachment means. As an alternative, or in addition to, gluing, portions of the single sheet 112 of corrugated material may be formed into tabs and slots, the tabs adapted to be inserted in to the slots.

FIG. 14 is a top view of the sheet 112 of corrugated material in a flat, pre-assembled configuration. In at least one preferred embodiment, the single sheet 112 of corrugated material is shipped as a flat sheet in order to save space. Furthermore, multiple single sheets can be packaged and shipped together. These flat sheets may be assembled into boxes after shipping is complete.

As shown in FIG. 14, the boundary of the sheet 112 of corrugated material is shown in solid lines and fold lines are shown as dashed lines. The single sheet comprises a base 114, four side walls 116,117, four side wall attachment portions 118, a first lid portion 120, a second lid portion 122, and two side portions 124, each with a tab 126. Two opposing side walls 116 include a slot 128. Each tab 126 is adapted to slide into and be retained within one of the slots 128 to seal the first lid portion 120 and the second lid portion 122 in a closed position.

To assemble the box 110 from the single sheet 112 of corrugated material, each of the side walls 116,117 is folded perpendicular to the base 114, and the outer surfaces of the four side wall attachment portions 118 are attached to the inner surfaces of side walls 116. The assembled box 110 is shown in FIGS. 13 and 15.

To seal the box 110 closed, the second lid portion 122 is folded over the opening, as seen in FIG. 16. Next, as seen in FIGS. 17 and 18, the first lid portion 120 is folded down over the opening to cover at least part of the second lid portion 122, securing the second lid portion 122 closed. Finally, as shown in FIG. 18, the tabs 126 are inserted into the slots 128 to hold the first lid portion 120, and therefore the second lid portion 122, in place, sealing the contents of the box 110.

An exemplary embodiment of the box 110 is shown in drawings 19-25 of the '904 publication. In particular, drawing 19 of the '904 publication is a photograph of a box in accordance with one or more preferred embodiments of the present invention. Drawing 20 of the '904 publication is a photograph of a side view of the box of drawing 19. of the '904 publication. Drawing 21 of the '904 publication is a photograph of the side of the box of drawings 19 of the '903 publication, showing a tab completely inserted into a slot. Drawing 22 of the '904 publication is a photograph of the side of the box of drawing 19 of the '904 publication, showing a tab partially inserted into a slot. Drawing 23 of the '904 publication is a photograph of the side of the box of drawing 19 of the '904 , showing a tab completelyremoved from a slot. Drawing 24 of the '904 publication is a photograph of the box of drawings 19 of the '904 publication, with the first and second lid portions partially open; and drawing 25 of the '904 publication is a photograph of a top view of the box of drawing 19 of the '904 publication, with the first and second lid portions partially open.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A blank that is convertible, by folding, into a container comprising a single-piece box having an integrally connected lid, the blank comprising a single sheet of material, the single sheet of material comprising:

(a) a bottom section;

(b) four side wall sections including a first side wall section, a second side wall section, a third side wall section, and a fourth side wall section;

(c) four side wall attachment portions; and (d) a lid section comprising, (i) a top portion, (ii) a left side portion having three lid fold lines, (iii) a right side portion having three lid fold lines, (iv) a front portion having two slots, (v) a left side tab portion, and (vi) a right side tab portion;

(e) wherein the three lid fold lines of the left side portion of the lid and the three lid fold lines of the right side portion of the lid are located such that, when the blank is folded and glued to form the container, the fold lines collectively bias the lid to maintain, (i) a stable open position of the container when in such open position, (ii) a stable intermediate position when in such intermediate position, and (iii) a stable closed position when in such closed position; and (f) wherein the bottom section, the four side wall sections, the four side wall attachment portions, and the lid portion are located such that, when the blank is folded and glued to form the container, (i) each of the side wall sections extends generally perpendicular to the bottom section;

(ii) an outer surface of each of the four side wall attachment portions is attached to an inner surface of one of the first side wall section, the second side wall section, the third side wall section, and the fourth side wall section;

(iii) the left side portion, the right side portion, and the front portion extend generally perpendicular to the top portion;

(iv) the left side tab portion and the right side tab portion extend generally perpendicular to the left side portion and right side portion, respectively; and (v) the left side tab portion and the right side tab portion extend into respective slots of the front portion.

2. The blank of claim 1, wherein the single sheet of material comprises a generally planar sheet of corrugated material.

3. The blank of claim 1, wherein the single sheet of material comprises cardboard.

4. The blank of claim 1, further comprising a decorative element on a surface of the blank.

5. The blank of claim 4, wherein the decorative element is adhered to a surface of the single sheet of material using adhesives.

6. The blank of claim 4, wherein the decorative element is printed directly on a surface of the single sheet of material.

7. A method of forming a container comprising a single-piece box having an integrally connected lid by folding a blank comprising a single sheet of material, the method comprising the steps of:

(a) providing a single sheet of material comprising, (i) a bottom section, (ii) four side wall sections including a first side wall section, a second side wall section, a third side wall section, and a fourth side wall section, (iii) four side wall attachment portions, and (iv) a lid section comprising, (A) a top portion, (B) a left side portion having three lid fold lines, (C) a right side portion having three lid fold lines, (D) a front portion having two slots, (E) a left side tab portion, and (F) a right side tab portion;

(b) folding each of the side wall sections perpendicular to the bottom section;

(c) attaching an outer surface of each of the four side wall attachment portions to an inner surface of one of the first side wall section, the second side wall section, the third side wall section, and the fourth side wall section;

(d) folding the lid section such that the left side portion, the right side portion, and the front portion are folded downward and perpendicular to the top portion;

(e) folding the left side tab portion and the right side tab portion perpendicular to the left side portion and right side portion, respectively; and (f) inserting the left side tab portion and the right side tab portion into respective slots of the front portion;

(g) the steps being performed such that the three lid fold lines of the left side portion of the lid and the three lid fold lines of the right side portion of the lid collectively bias the lid to maintain, (i) a stable open position of the container when in such open position, (ii) a stable intermediate position when in such intermediate position, and (iii) a stable closed position when in such closed position.

8. The method of claim 7, wherein the step of attaching the outer surfaces of the four side wall attachment portions is performed using an adhesive.

9. The method of claim 7, wherein the single sheet of material comprises a generally planar sheet of corrugated material.

10. The method of claim 7, wherein the single sheet of material comprises cardboard.

11. The method of claim 7, wherein a decorative element is located on a surface of the blank.

12. The method of claim 11, further comprising adhering the decorative element to a surface of the single sheet of material using adhesives.

13. The method of claim 11, further comprising printing the decorative element directly on a surface of the single sheet of material.

14. A container with an integrally connected lid formed by folding a single sheet of material, the single sheet of material comprising:

(a) a bottom section;

(b) four side wall sections including a first side wall section, a second side wall section, a third side wall section, and a fourth side wall section;

(c) four side wall attachment portions; and (d) a lid section comprising, (i) a top portion, (ii) a left side portion having three lid fold lines, (iii) a right side portion having three lid fold lines, (iv) a front portion having two slots, (v) a left side tab portion, and (vi) a right side tab portion;

(e) wherein the three lid fold lines of the left side portion of the lid and the three lid fold lines of the right side portion of the lid are located such that the fold lines collectively bias the lid to maintain, (i) a stable open position of the container when in such open position, (ii) a stable intermediate position when in such intermediate position, and (iii) a stable closed position when in such closed position;

(f) wherein each of the side wall sections extends generally perpendicular to the bottom section;

(g) wherein an outer surface of each of the four side wall attachment portions is attached to an inner surface of one of the first side wall section, the second side wall section, the third side wall section, and the fourth side wall section;

(h) wherein the left side portion, the right side portion, and the front portion extend generally perpendicular to the top portion;

(i) wherein the left side tab portion and the right side tab portion extend generally perpendicular to the left side portion and right side portion, respectively; and (j) wherein the left side tab portion and the right side tab portion extend into respective slots of the front portion.

15. The container of claim 14, wherein the outer surfaces of the four side wall attachment portions are attached with an adhesive.

16. The container of claim 15, wherein the single sheet of material comprises cardboard.

17. The container claim 16, further comprising a decorative element applied to an exterior surface of the single sheet of material.

18. The container of claim 17, wherein the decorative element is adhered to a surface of the single sheet of material using adhesives.

19. The container of claim 17, wherein the decorative element is printed directly on a surface of the single sheet of material.

* * * * *